United States Patent [19]

Den Besten et al.

[11] Patent Number: 4,684,176

[45] Date of Patent: Aug. 4, 1987

[54] CUTTER BIT DEVICE

[76] Inventors: Leroy E. Den Besten, P.O. Box 344, Valatie, N.Y. 12184; Cletis P. Pinkerton, 7785 Mountain Ash Dr., Mentor, Ohio 44060

[21] Appl. No.: 834,116

[22] Filed: Feb. 24, 1986

Related U.S. Application Data

[63] Continuation of Ser. No. 610,618, May 16, 1984, abandoned.

[51] Int. Cl.[4] ..... E21C 35/18

[52] U.S. Cl. ..... 299/91

[58] Field of Search ..... 299/91, 92, 86; 37/141 T, 142 R; 172/699, 700; 175/412, 413

[56] References Cited

U.S. PATENT DOCUMENTS

| | | | |
|---|---|---|---|
| 3,627,381 | 12/1971 | Krekeler | 299/86 |
| 4,201,421 | 5/1980 | Den Besten et al. | 299/86 |
| 4,247,150 | 1/1981 | Wrulich et al. | 299/86 |
| 4,484,783 | 11/1984 | Emmerich | 299/86 |

*Primary Examiner*—Stephen J. Novosad
*Assistant Examiner*—Thomas J. Odar
*Attorney, Agent, or Firm*—Watts, Hoffmann, Fisher & Heinke Co.

[57] ABSTRACT

The present invention relates to cutter bit devices and more particularly to cutter bit devices of the type for detachable connection to a rotatable member such as an excavating wheel, chain cutter, cement saw or the like for various excavating operations as in road planing or scarifying, long-wall coal mining, sawing concrete or the like.

17 Claims, 14 Drawing Figures

CUTTER BIT DEVICE

This application is a continuation of application Ser. No. 610,618, filed 5/16/84, now abandoned

TECHNICAL FIELD

The present invention relates to cutter bit devices and more particularly to cutter bit devices of the type for detachable connection to a rotatable member such as an excavating wheel, chain cutter, cement saw or the like for various excavating operations as in road planing or scarifying, long-wall coal-mining, sawing concrete or the like.

BACKGROUND ART

Heretofore, there have been provided various types of cutter bits for cutting and excavating operations including, for example, road planing or scarifying wherein the bit is detachably connected to a rotating member such as to the rim of an excavating wheel by means of a mounting block or holder, that is generally fixedly mounted, as by weldments or the like, to the rim of the wheel. In such cases, the cutter bit has, in turn, been detachably mounted within the mounting block or holder member by various retainer systems which holds the cutter bit within the block to enable rotational movement of the cutter bit relative to the mounting block or holder member. Recently, for example, there has been provided an elongated wear sleeve member arranged and constructed to rotatably retain the cutter bit within the mounting block or holder member and that also reduces wear between the component parts during normal uses thereof. Such type of retainer system is illustrated in U.S. Pat. No. 4,201,421 to James O'Connell and Leroy Den Besten.

In the construction and excavating fields, there has been a relatively constant effort to improve the rotation, strength and wear characteristics of the mounting system including the cutter bit. Such cutter bits for various reasons including, for example, adverse operating conditions, manufacturing tolerances, abrasive wear or the like, have a tendency to mis-align resulting in a wobbling effect that tends to compound the abrasive wear resulting in the requirement to replace the cutter bits. Another cause for mis-alignment resulting in further bit wear is the tendency for dirt to be picked up and lodged between the mounting block and/or/holder and the bit. This condition not only causes the bit to mis-align during rotation but also, under severe operating conditions, prevents rotation of the bit resulting in non-uniform wear on the bit. Accordingly, more emphasis is now being placed on reducing the cost of such bits while maintaining their strength and operating performance characteristics.

DISCLOSURE OF THE INVENTION

The present invention provides substantially improved cutter bits for construction and excavating applications which, it is believed, can be produced at a reduced cost and at which afford significantly improved performance characteristics as well as improved strength. In the invention, the bit includes an elongated body of a solid construction referred to generally as the conical or pick-type bit. The bit has a cylindrical shank construction that enables the same to be rotatably mounted in the bore of a mounting block or a holder member which, in turn, is mounted on some type of rotatable member (i.e. wheel or the like) so as to be brought into cutting engagement with the desired work strata, such as in road planing and/or scarifying, trenching, coal mining, concrete sawing or the like.

In a preferred form, the bit specifically includes an elongated solid body having a unitary conical head portion from which extends an axial, unitary shank portion adapted to be rotatably disposed within the bore of a mounting block or holder member. The head portion may be provided with a suitable cutting element, such as a carbide tip or the like, and the shank portion may be provided with a unitary annular flange at its terminal end so as to retain on the shank portion in one form an elongated retainer and/or wear sleeve member that enables the bit to generally rotate relative to the mounting block or holder member.

In the invention, the conical head portion terminates generally adjacent its maximum transverse dimension in a peripheral, unitary skirt portion defining a generally mushroom-shaped configuration. This skirt portion defines a generally frusto-conical recess which provides, in effect, a load or thrust bearing socket for sliding coacting engagement on a corresponding and confronting peripheral thrust bearing surface defined by a shoulder portion on the mounting block or holder member. By this arrangement, the symmetric mushroom-shaped construction of the skirt portion provides a self-centering action on the bit and distributes the load forces uniformly inwardly in a direction toward the longitudinal rotational axis of the bit. This acts to promote self-sharpening and uniform bit wear thereby prolonging bit life as well as enhanced bit performance.

It has further been found that the geometry of those bits utilizes less material and hence reduces bit cost. Also, such bit construction facilitates interchangability of bit gauge (i.e. shank I.D.) and the mushroom configuration provides a protective cover to minimize cutting particles from entering and clogging the component parts thereby to enhance bit rotation.

In the invention, the mushroom head configuration is defined by a skirt-like flange portion that covers the transverse surface of the bit holder or block. This construction provides a maximum external surface area that not only promotes rotational movement of the bit relative to the block due to torque forces imparted from the excavated strata but also provides for a frusto-conical sloped displacement of the excavated strata away from the bit. By this design, the excavated strata (i.e. dirt) is diverted away from the inter-connection between the bit and block so as to prevent the dirt from working its way into the block causing clogging, bit wobble and non-uniform bit wear. By this construction, the dirt could only enter the bore in the block by taking a generally S-shaped path that would not be permitted by the design of the present invention.

Other advantages and objects of the present invention will become apparent as the following description proceeds when taken in conjunction with the drawings.

BEST MODE FOR CARRYING OUT THE INVENTION

Figure 1:
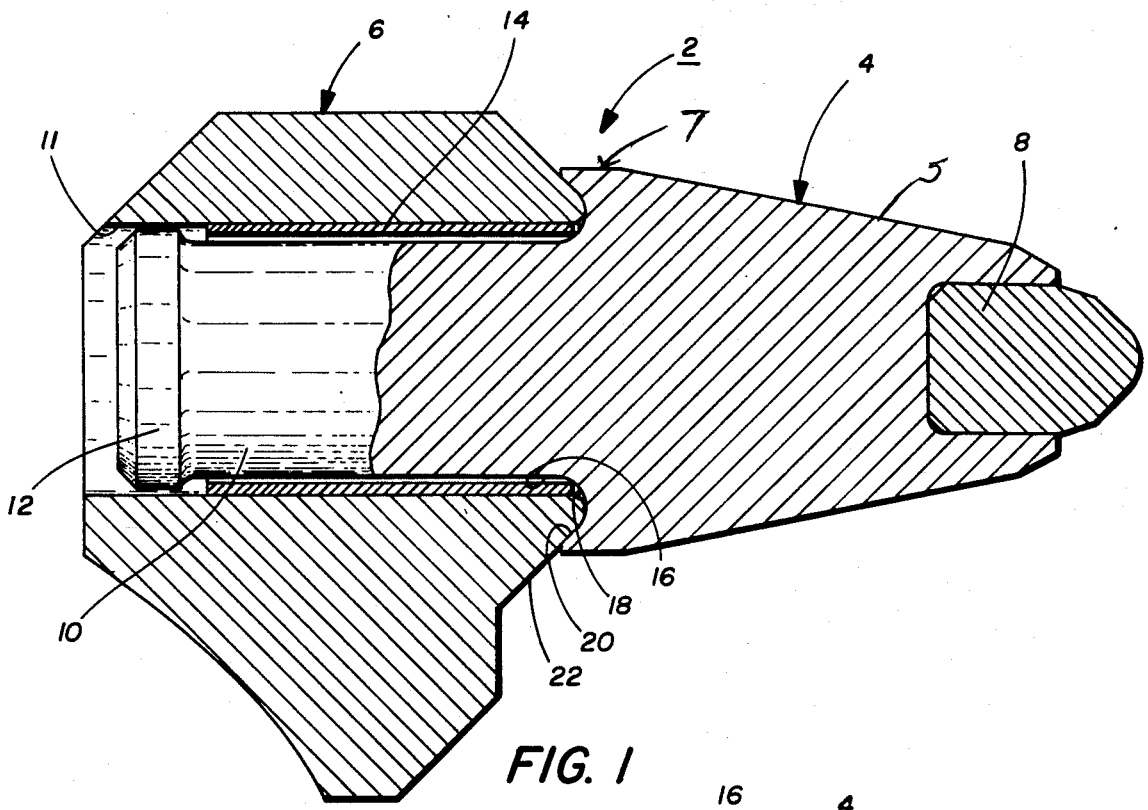
FIG. 1 is a vertical section view of the improved cutter bit device of the invention mounted for rotation within a mounting block or holder member.
Figure 2:
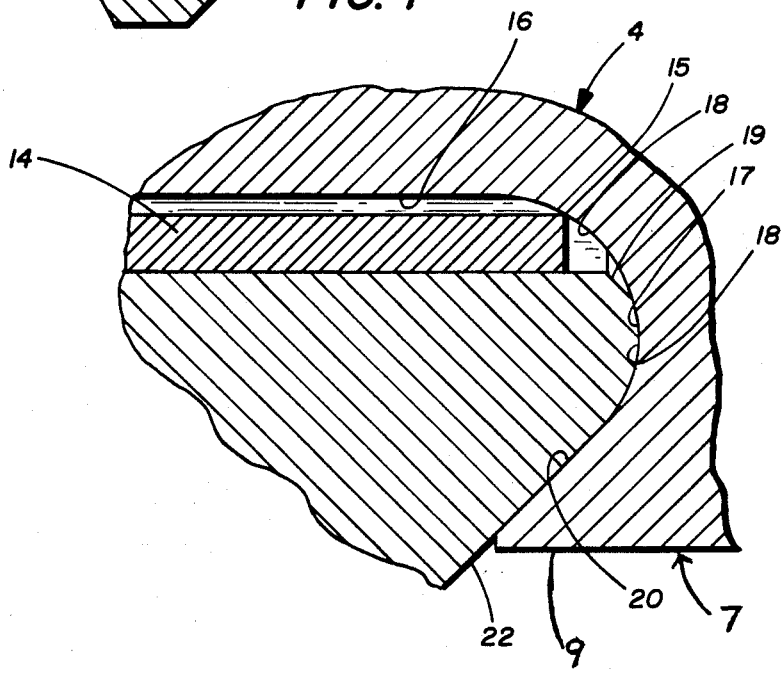
FIG. 2 is a fragmentary, exploded view on an enlarged scale illustrating the juncture area between the cutter bit device and the confronting surfaces of the mounting block or holder member.
Figure 3:
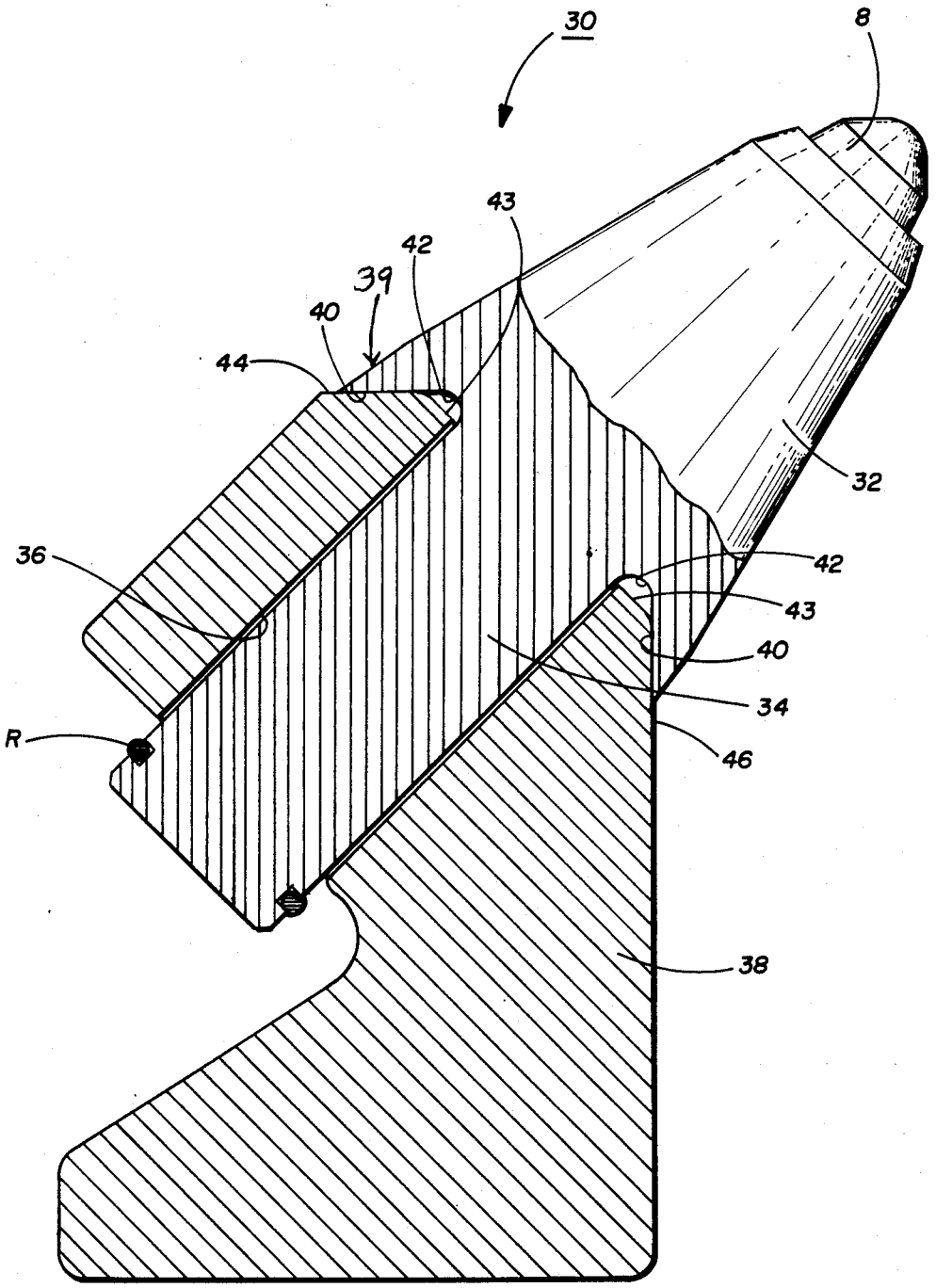
FIG. 3 is a side elevation view, partly in section, illustrating a modified form of the cutter bit device made in accordance with the invention.

Referring again to the drawings and in particular to FIGS. 1–3 thereof, there is illustrated one form of the cutter bit assembly made in accordance with the present invention. In the form shown, the assembly, designated generally at 2, includes a conical bit member 4 which is disposed for rotation about its longitudinal central axis in a mounting block or holder member 6. The block member 6 has a central bore 11 adapted to receive therein the shank of the bit and with the bit being held against axial movement by means of a resilient wear sleeve retainer 14 of the type illustrated in aforesaid U.S. Pat. No. 4,201,421.

More specifically, the conical bit member 4 illustrated in FIGS. 1 and 2 includes a conical head portion 5 and an integral reduced shank portion 10 that terminates in an integral enlarged diameter shoulder portion 12. The wear sleeve retainer 14 is of a resilient split-sleeve construction having an expanded diameter that is greater than the diameter of the bore 11 in the block member 6 so as to be compressed radially inwardly upon insertion of the shank of the bit within the block member to hold the bit in the block member while allowing the bit member to rotate via the clearance, as at 16, relative to the block member. In this condition, the wear sleeve retainer 14 is held in a non-rotatable condition relative to the block member and the shoulder portion 12 provides an abutment or stop by coacting engagement with the confronting terminal end of the wear sleeve retainer 14 to prevent axial withdrawal of the bit member from the block.

As best illustrated in the enlarged view of FIG. 2, the conical head 5 of the bit member includes an integral unitary skirt portion, designated generally at 7, defining a generally mushroom-shaped configuration. In the form illustrated, the skirt portion 7 is defined by an outer radial, generally flat surface 9 having a diameter that is greater than the corresponding diameter of the bore 11 in the block. The skirt portion 7 has an annular undercut groove defined by curved surfaces 17 and 18 that present a generally concave surface configuration adapted for a camming coacting engagement on a confronting convex surface 17 defined by the entry end of the bore 11 in the block 4. In this form, the concave surface 18 merges smoothly into a generally linear surface 20 that merges with a corresponding generally linear surface 22 defined by the external conical surface of the block 4. In this form, it will be seen that the terminal end edge, as at 15, of the wear sleeve retainer 14 will be positioned axially forwardly or rearwardly so as to remain out of engagement with the concave groove surface 18. Also, in the form shown the entry opening into the bore 11 may have a chamfer surface, as at 19, to facilitate entry of the bit shank into the bore of the block, as known in the art.

By this construction and arrangement the enlarged diameter skirt portion 7 defines the annular undercut groove 18 that receives therein a generally corresponding shaped convex surface 17 defining the entry end of the bore 11 in the block so that there is provided a thrust bearing mounting between the component parts during rotation of the bit relative to the block. The symmetric construction of the skirt portion provides a self-centering action on the bit and distributes the load forces uniformly inwardly in a direction toward the longitudinal rotational axis of the bit to promote uniform bit wear thereby prolonging bit life as well as enhanced bit performance. Accordingly, during the use of this point-attack bit the axial load forces are distributed radially inwardly toward the rotational central axis of the bit so as to minimize rotational mis-alignment of the bit thereby to maximize uniform bit wear.

In FIG. 3, there is illustrated another embodiment of a bit assembly, designated generally at 30, made in accordance with the invention. In this form, the conical bit member 32 has an integral shank portion 34 that is retained within the bore 36 of block member 38 by means of a retainer ring typically known as a hog or snap ring. In this form, it will be seen that the enlarged diameter skirt portion 39 indicates a generally frusto-conical configuration having an internal recess groove of a generally inverted V-shaped configuration defined by a generally linear surface 40 that merges into annular recess groove or radius 42. The linear surface 40 is disposed for camming coacting engagement or a correspondingly shaped generally linear surface 44 of the block member 38. In this form, the block member 38 has a generally flat front surface 46 that merges into the surface 44 to present a generally frusto-conical support surface for the corresponding skirt portion 39 of the bit. Accordingly, the entry end, in this form, of the bore 36 in a block may be of a generally flat surface construction, as at 43.

Figure 4:
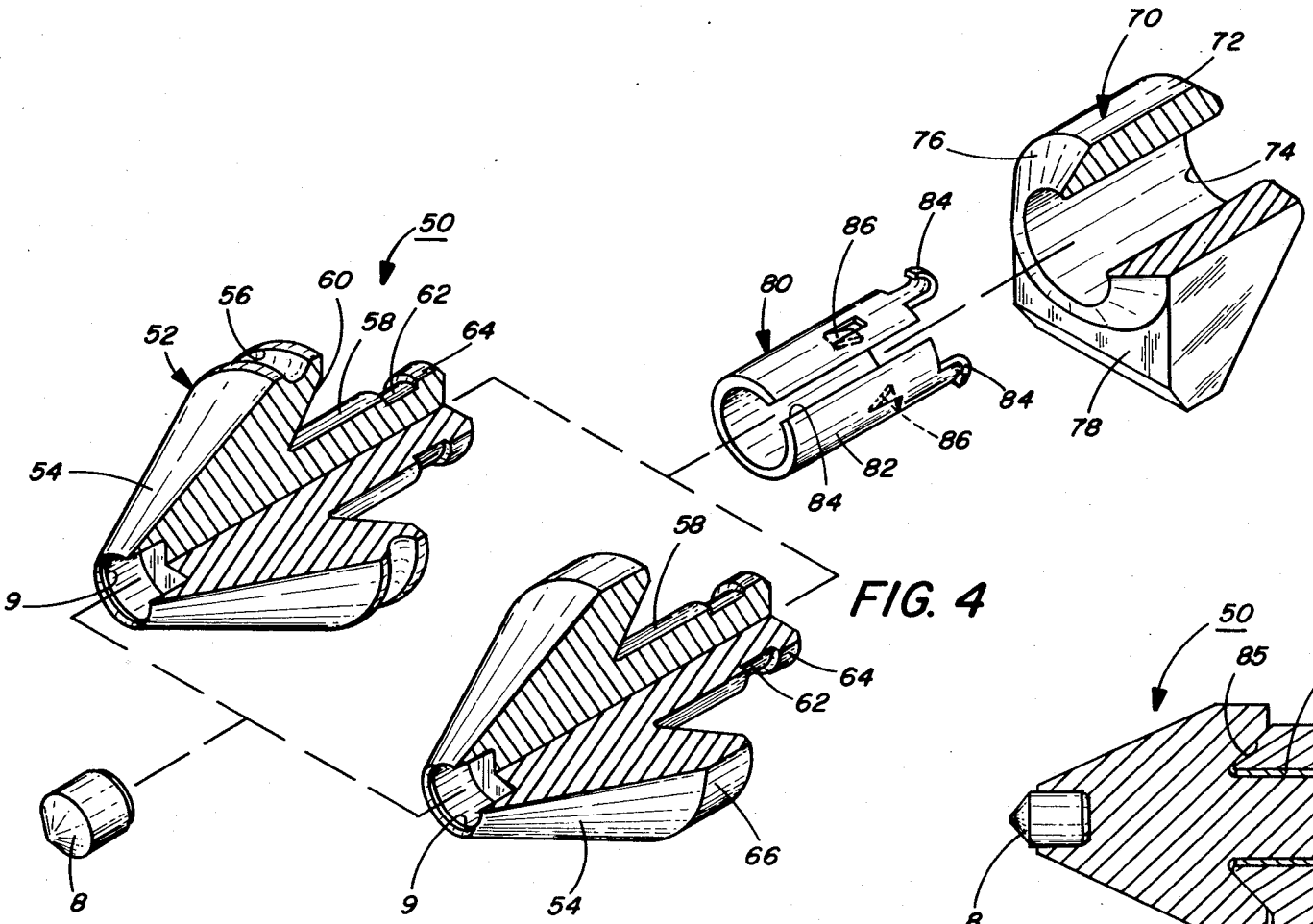
FIG. 4 is an assembly view, partly in section, illustrating another modified form of the cutter bit device in conjunction with a new and novel construction of a retainer member for rotatably supporting the bit member within the mounting block.
Figure 5:
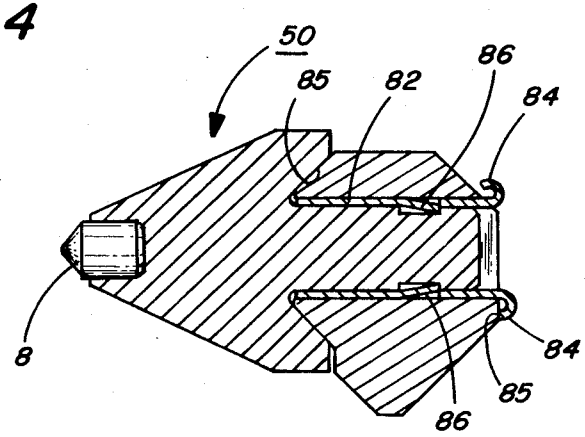
FIG. 5 is a vertical section view of the assembled form of the cutter device illustrated in FIG. 4.

In FIGS. 4 and 5, there is illustrated in exploded view another form of the cutter bit assembly designated generally at 50. In this form, the conical bit member 52 includes a conical head portion 54 with an integral cylindrical shank portion 58. The shank portion 58 has an annular recessed groove 62 defined by an integral annular shoulder portion 64. In this form, the head portion of the bit is provided with an annular puller groove 56 so that the bit may be removed from the block by the means of a pry-bar, as known in the art. In an alternate form, the puller groove 56 may be omitted and the head portion may be provided with an annular radial surface 66 defining the skirt portion 60.

In this form, the block member 70 may be of the general type illustrated in FIG. 1 and includes a body member 72 having an axial bore 74 extending therethrough. The forward side of the body defines a frusto-conical surface 76 adapted for camming coacting engagement on the confronting interior frusto-conical surface 85 of the skirt portion, as illustrated in FIG. 5. Accordingly, in this embodiment the frusto-conical surfaces 76 and 85 provide a generally straight-line surface contact during rotational movement of the bit relative to the block and similiar to that illustrated in respect to FIG. 3.

In this embodiment, an elongated, split-sleeve retainer member, designated generally at 80, is provided to rotatably mount the bit 50 within the block 70. The retainer includes a cylindrical body having a slit 83 extending along the length thereof. By this construction, the retainer having a greater unexpanded diameter than the corresponding diameter of the bore 74 in the block, the retainer can be radially compressed via the slit 83 to enable the retainer to be resiliently inserted within the bore of the block. In this form, the retainer may include a pair of oppositely disposed integral spring-fingers 86 which are cut-out from the material thereof. These spring-fingers 86 are adapted to be received in the corresponding annular groove 62 provided on the shank of the bit to prevent axial withdrawal of the bit from the block. In this form, the retainer may be provided with two or more integral tangs 84 having a generally C-shaped configuration for coacting abutting engagement with the confronting rear surface of the block thereby to prevent axial withdrawal of the bit from the block. Accordingly, the combined finger 86 and tang 84 construction enables the bit to be rotatably held within the block while being prevented from axial dislodgement therefrom. In the assembled condition, the retainer 80 is held in a non-rotatable condition relative to the block, as in the embodiment of FIG. 1.

Figure 6:
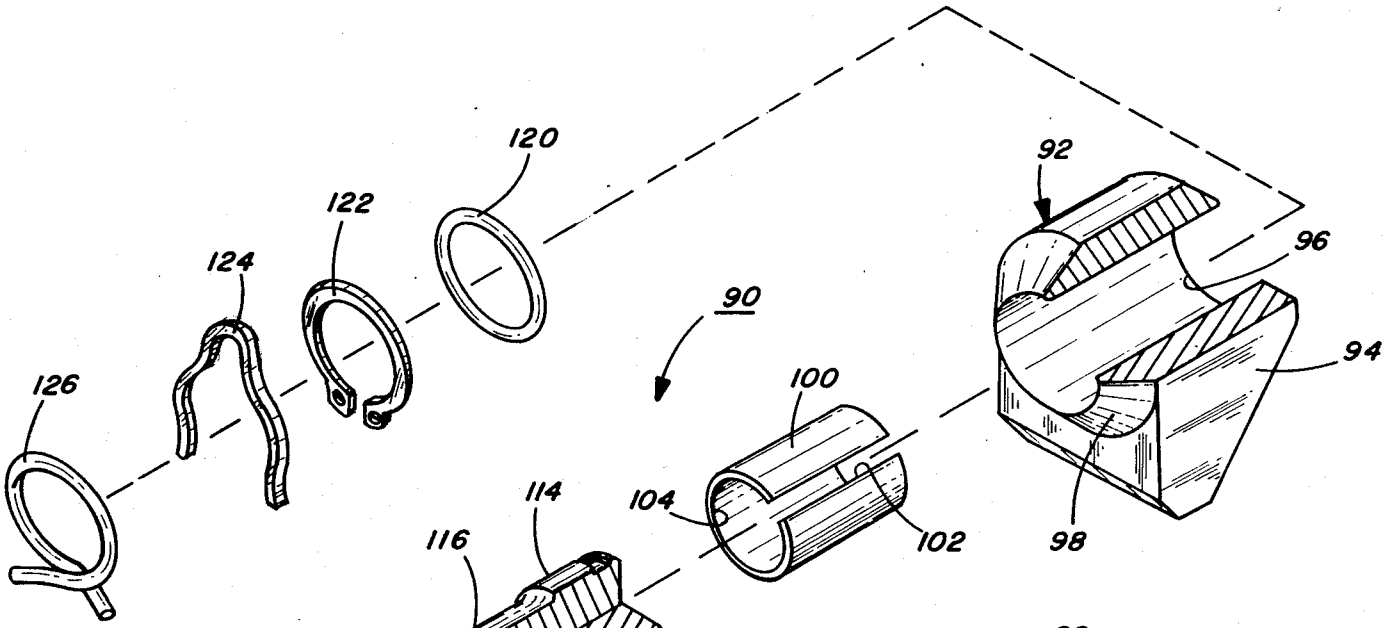
FIG. 6 is another assembly view illustrating a further modified form of the cutter device with the elongated wear sleeve member for rotatably mounting the bit member within the supporting block.
Figure 6:
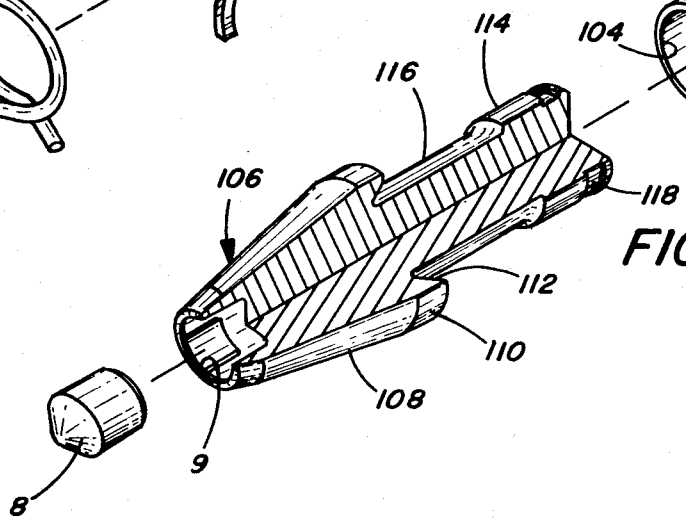
Figure 7:
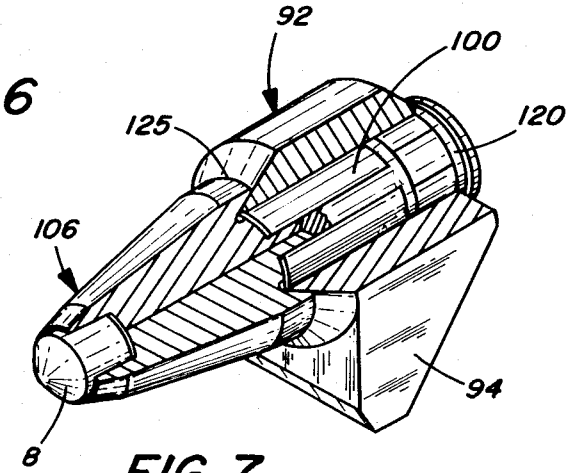
FIG. 7 is a generally perspective view, partly in section, illustrating the assembled form of the cutter bit device of FIG. 6.

In FIGS. 6 and 7 there is illustrated a further embodiment of the cutter bit assembly designated generally at 90. In this form, the block 92 is generally identical to that illustrated in FIG. 4 and includes a body having an axial bore 96 extending therethrough. The entry end of the bore 96 is defined by a frusto-conical surface 98 that provides a generally linear camming coacting engagement for the confronting linear surface 112 provided by the skirt portion of the bit.

The cutter bit 106 includes a conical head portion 108 defining a radial skirt portion 110 having a frusto-conical undercut surface 112. In this form, the shank includes an elongated reduced diameter groove 116 defined by the integral annular shoulder 114. The groove 116 is adapted to receive the wear sleeve retainer 100. The wear sleeve retainer 100 may be of the same construction as illustrated in FIG. 1 and includes a cylindrical split-body 104 defined by a lengthwise slit 102.

In this form, the shank of the bit may also be provided with a second annular groove 118 that extends rearwardly beyond the rear surface of the block and is adapted to receive, in this form, the retainers 120, 122, 124 or 126 therein. Accordingly, in this form the wear sleeve retainer holds the bit rotatably within the block while being held in a non-rotational condition relative to the block. The resilient retainer clips 120, 122, 124 and 126 will then be mounted in a snap-action relation in a groove 118 to prevent axial withdrawal of the bit from the block during use thereof.

Figures 8, 9:
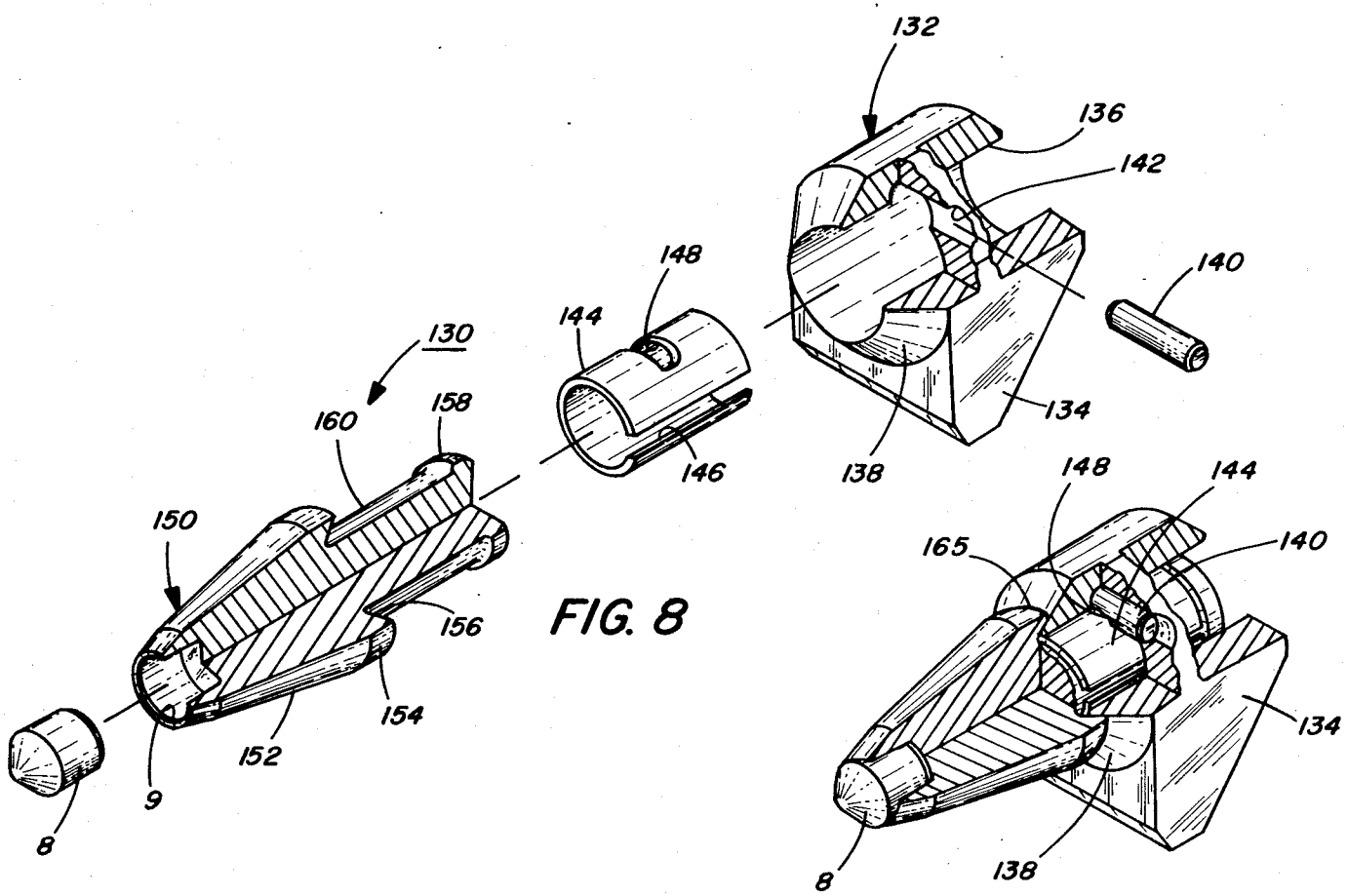
FIG. 8 is an assembly view of a still modified form of the cutter device made in accordance with the present invention.
FIG. 9 is a generally perspective view, partly in section, of an assembled form of the cutter assembly illustrated in FIG. 8.

In FIGS. 8 and 9 there is illustrated a further embodiment of the cutter bit assembly, designated generally at 130, of the invention. Here again, the block 132 includes a body 134 having an axial bore 136 extending therethrough. A frusto-conical entry surface 138 engages in a camming relation with the confronting frusto-conical surface on the skirt portion of the bit. In this form, the block, however, has a radial, off-set passage 142 extending therethrough and adapted to receive a retainer pin element 140 therein.

In this form, the wear sleeve retainer 144 has a longitudinal slit 146 and also has a radial cut-out slot 148 adapted to receive the pin element 140 therein.

The cutter bit 150 includes a conical head portion 152 including an integral skirt portion 154 defining the frusto-conical surface for camming engagement with the corresponding frusto-conical surface 138 on the block. The bit shank includes an annular groove 160 defined by an integral shoulder portion 158.

As best illustrated in FIG. 9, the wear sleeve retainer 144 is pre-assembled in the groove 160 on the bit shank and then the retainer bit and retainer are inserted, as a unit, into the bore 103 of the block. The retainer then resiliently expands outwardly so that the bit is rotatably held relative to the block with the retainer itself being held in a non-rotatable condition, as aforesaid. In this form, the pin element 140 is then inserted into the passageway 142 and through the slot 148 provided in the retainer thereby to provide added holding power to prevent axial dislodgement of the bit relative to the block during useage thereof.

Figure 10:
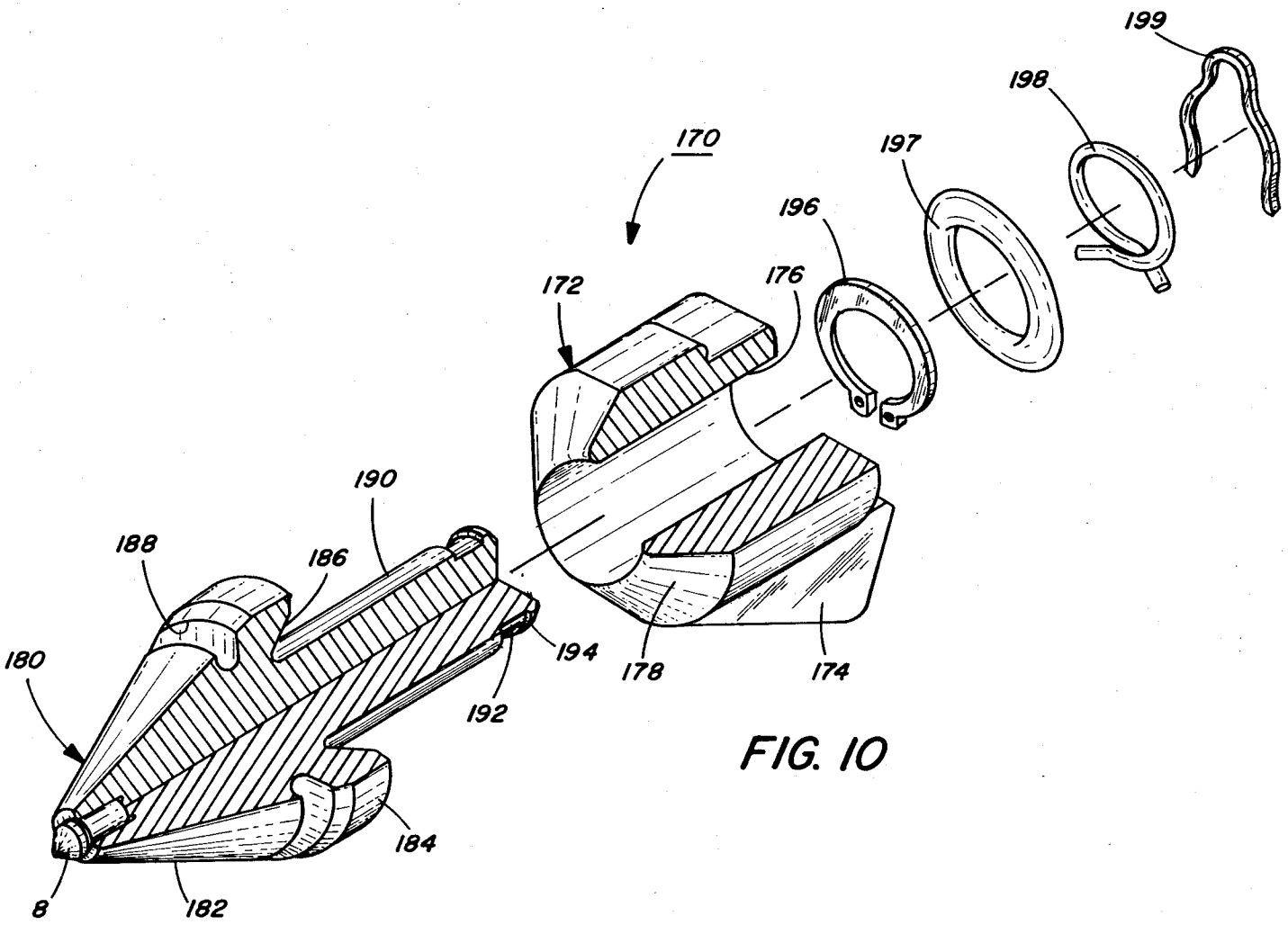
FIG. 10 is an assembly view of still further modified form of the cutter assembly of the present invention.

In FIG. 10 there is illustrated a further embodiment of the cutter bit assembly designated generally at 170. In this form, the block member 172 includes a body 174 having an axial bore 176 extending therethrough and with the frusto-conical surface 178 adapted to rotatably receive, in thrust bearing relation thereon, the confronting frusto-conical surface 186 presented by the skirt portion of the bit.

In this form, the bit 180 includes a conical head portion 182 that terminates in the enlarged diameter skirt portion 184 defining the frusto-conical surface 186. Here again, the head portion of the bit may be provided with a puller groove, as at 188, as known in the art. In this form, the integral shank portion 190 is of an elongated construction and has an annular groove 192 defined by integral annular shoulder 194. In this form, the shank 190 has a reduced diameter relative to the bore 176 in the block and with the groove 192 adapted to receive any one of the retainers 196, 197, 198, or 199 to prevent axial withdrawal of the bit from the block during usage thereof. Accordingly, in this form, the wear sleeve retainer illustrated in FIG. 11, for example, has been omitted.

Figures 11, 12:
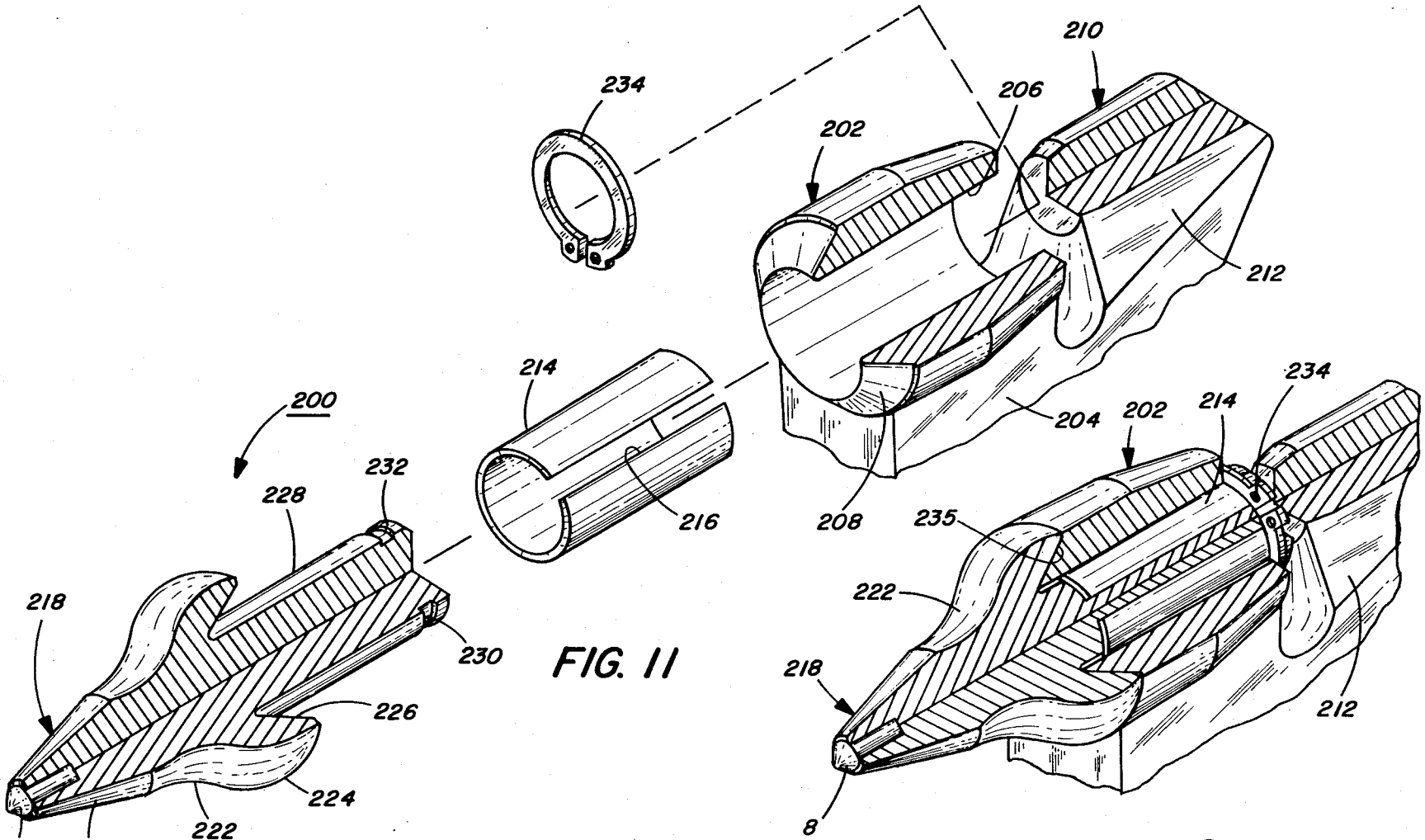
FIG. 11 is an assembly view of yet another modified form of the cutter assembly of the present invention.
FIG. 12 is a generally perspective view, of the cutter assembly of FIG. 11 in the installed position thereof.

In FIGS. 11 and 12 there is illustrated a further embodiment of the cutter bit assembly, designated generally at 200, of the invention. In this form, the block 202 is of an anvil construction including a base portion 204 having an axial bore 206. The block includes the frusto-conical surface 208 for camming coacting engagement with a corresponding frusto-conical surface provided on the skirt portion of the bit. In this form, the block has an integral anvil member 210 defined by an anvil portion 212 adapted to provide an abutment or stop for the shank-end of the bit, as known in the art. In this form, the bit is rotatably mounted within the block by means of the elongated wear-sleeve retainer 214 which has the slit 216 construction as aforesaid.

In this form, the cutter bit member 218 has a conical head portion 220 that merges into a generally S-shaped skirt portion 222. Skirt portion 222 has a convex outer surface 224 on the exterior thereof and the frusto-conical generally linear surface 226 on the interior thereof. These surfaces contact one another in a generally planar line-contact, as at 235, in FIG. 12.

In this form, the bit includes an integrally elongated shank portion 228 having an annular groove 230 and shoulder portion 232. The groove 230 is adapted to receive the hog or C-ring 234. In this form, the terminal end of the shank portion is provided with additional support for transmitting the load forces on the bit via the anvil portion 212.

Figures 13, 14:
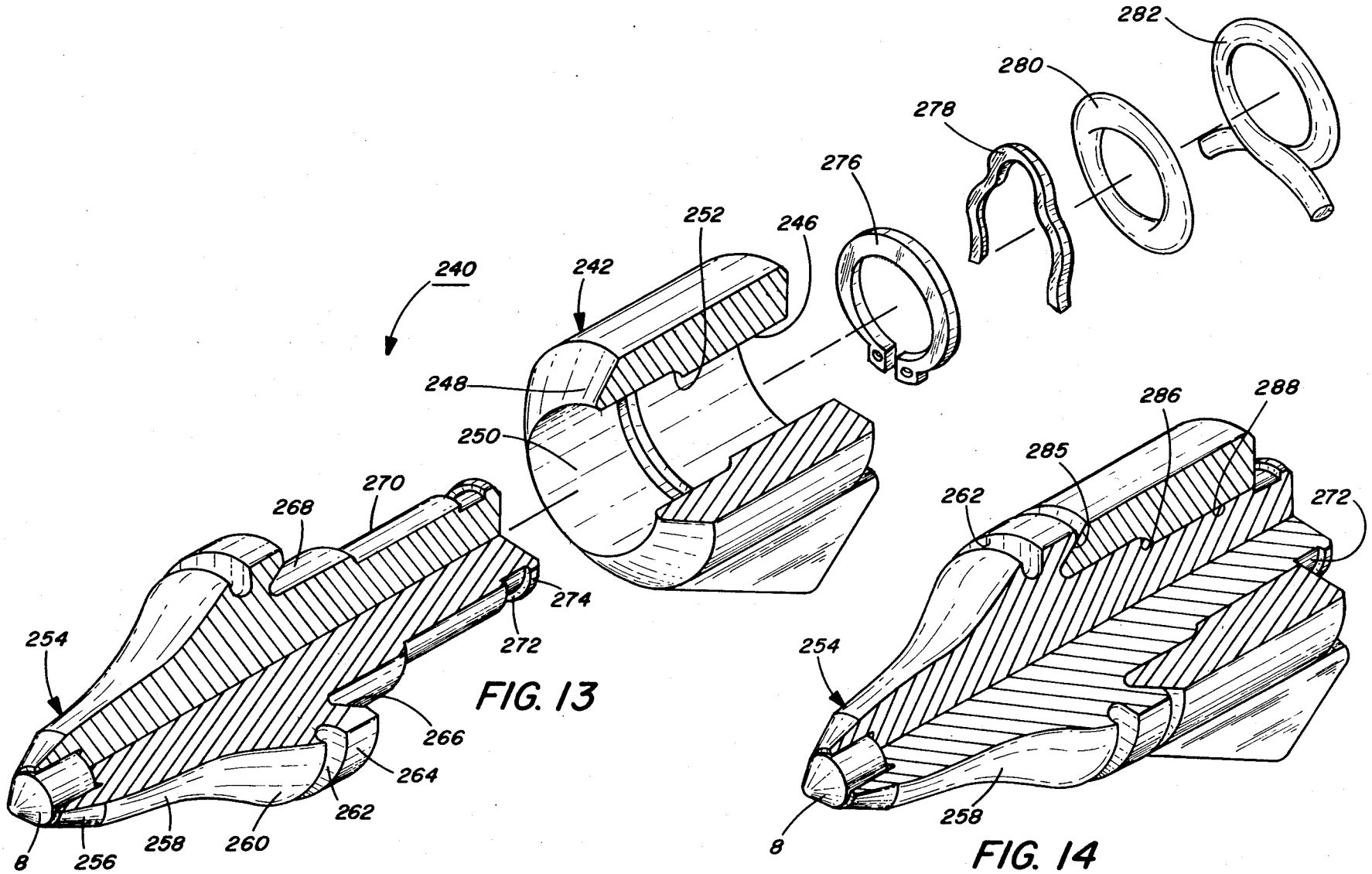
FIG. 13 is an assembly view of a still further modified form of the cutter assembly of the present invention.
FIG. 14 is a generally perspective view, partly in section of the cutter assembly of FIG. 13 in the installed position thereof.

In FIGS. 13 and 14 there is illustrated a still further embodiment of the cutter bit assembly, designated generally at 240, of the invention. In this form, the block or holder member 242 includes an annular bore 246 but with an enlarged diameter counter-sink portion 250 that defines therebetween an interior radial shoulder portion 252. This radial shoulder portion may be curved or have a radius so as to receive a correspondingly shaped surface on the bit shank.

In this form, the cutter bit 254 includes a conical head portion 256 that merges into a curved concave portion defined by surfaces 258 and 260 that curve smoothly and outwardly into a radial skirt portion 264. The skirt portion 264 has the frusto-conical interior surface 266 that rotatably engages with the confronting frusto-conical surface 248 of the block. In this form, the shank of the bit is of a stepped configuration defining a first enlarged diameter shoulder portion 268 and an elongated reduced diameter shoulder portion 270 that defines therebetween a curved external shoulder portion 286. This curved shoulder portion 286 (FIG. 14) engages against the internal radial shoulder portion 252 of the block with the reduced diameter portion 270 of the shank engaged rotatably with the confronting interior surface, as at 288, of the bore 246 of the block. Here again, the shank portion may be provided with an annular groove 272 defined by annular shoulder 274 to receive one of the retainer rings 276, 278, 280 or 282 to prevent axial withdrawal of the cutter bit relative to the block.

From the foregoing description and accompanying drawings, it will be seen that in the various embodiments the cutter bit is provided with an integral skirt portion having an enlarged cross-sectional dimension (diameter) relative to the bore in the mounting block, and with such skirt portion having a generally frusto-conical interior configuration that provides a thrust or load bearing seat construction for rotatable engagement with a correspondingly shaped surface construction provided on the block. As will be seen, this interior frusto-conical construction will have a curved or linear configuration or a combination thereof so as to provide a smooth rotational thrust bearing engagement between the bit and block. Accordingly, the bit may be rotatably mounted within the block and held frictionally by a wear sleeve retainer or without such retainer and with the bit being axially restrained against movement by various types of retainer clips. Because the cutter bit is rotated to some extent during each picking stroke, the conical head portion of the cutter bit is self-sharpened by substantially even wear due to the uniform distribution of load forces resulting from the construction and function of the enlarged mushroom-shaped skirt portion of the cutter bit. This enlarged skirt-like flange construction promotes this rotational movement of the bit about its longitudinal central axis due to the torque forces from the excavated dirt. This skirt-like flange bridges the exposed surface of the block and acts like an impeller to promote this rotation and prevents the dirt from working its way into the bore in the block by requiring the dirt to follow a generally S-shaped path that is not generally feasible with the present invention. It is recognized that other modifications may be made to the present invention including any equivalents thereof as contemplated in the following claims.

We claim:

1. A cutter bit device adapted for use with a mounting block member for excavating operations, the cutter device being of an elongated construction having a conical head member and an integral shank member, said conical head member having a forward minimum diameter and a rearward maximum diameter, the axial distance between said front and rear ends defining a generally frusto-conical configuration, said rear end defined by an enlarged transverse cross-sectional dimension greater than the corresponding transverse cross-sectional dimension of a bore provided in said mounting block member and defining a peripheral skirt-like flange portion extending rearwardly toward block member, said skirt-like portion defining with said shank portion an annular, interior cam-like seat adapted to receive therein a generally correspondingly shaped cam-like follower surface formed on said block member, said cam-like seat and cam-like follower surfaces together providing a thrust-bearing connection between said block and bit members during rotation of said bit member relative to said block member, the annular cam-like surface of said skirt-like flange portion has a generally inverted frusto-conical configuration adapted for thrust-bearing rotational movement on a generally correspondingly frusto-conical surface defined by the cam-like follower surface provided on said block member, and said annular interior cam-like seat surface has a generally inverted frusto-conical configuration adapted to receive a generally correspondingly shaped configuration provided by the annular exterior cam-like follower surface on said block member.

2. A cutter bit device in accordance with claim 1, wherein said skirt-like flange portion has an axial length sufficient to be disposed in overlapping relation with the cam-like follower surface on said block member.

3. A cutter bit device in accordance with claim 1, wherein the annular cam-like seat surface of said skirt-like flange portion has a generally concave configuration in transverse cross-section.

4. A cutter bit device in accordance with claim 1, wherein said skirt-like flange portion is formed from the material of the conical head portion of said bit member.

5. A cutter bit device in accordance with claim 1, wherein said skirt-like flange portion is of a symmetric configuration and has a cross-sectional dimension substantially greater than the corresponding cross-sectional dimension of the bore provided in said block member.

6. A cutter bit device in accordance with claim 1, wherein said skirt-like flange portion extends axially rearwardly so as to be disposed in overlapping, thrust-bearing relation relative to the confronting exposed cam-like follower surface provided on said block member.

7. A cutter bit device in accordance with claim 1, including a split tubular retainer mounted on the shank portion of said bit member for retaining said bit member against axial movement relative to said block member while permitting rotation of said bit member relative to said block member.

8. A cutter bit device in accordance with claim 1, wherein the said retainer is on substantially all of the exposed external surface of said shank portion, and said retainer being held non-rotational relative to said block member so as to accept substantially all of the wear on the bore of the block member resulting from interaction between the shank portion and the bore.

9. A cutter bit device in accordance with claim 1, wherein said annular interior cam-like seat surface has a generally inverted frusto-conical configuration adapted to receive a generally correspondingly shaped configuration provided by the annular exterior cam-like follower surface on said block member.

10. A cutter bit device in accordance with claim 1, wherein said skirt-like flange portion has an axial length sufficient to be disposed in overlapping relation with the cam-like follower surface on said block member.

11. A cutter bit device in accordance with claim 1, wherein the annular cam-like seat surface of said skirt-like flange portion has a generally concave con-figuration in transverse cross-section.

12. A cutter bit device in accordance with claim 1, wherein said skirt-like flange portion is formed from the material of the conical head portion of said bit member.

13. A cutter bit device in accordance with claim 1, wherein said skirt-like flange portion is of a symmetric configuration and has a cross-sectional dimension substantially greater than the corresponding cross-sectional dimension of the bore provided in said block member.

14. A cutter bit device in accordance with claim 1, wherein said skirt-like flange portion extends axially rearwardly so as to be disposed in overlapping, thrust-bearing relation relative to the confronting exposed cam-like follower surface provided on the block member.

15. A cutter bit device in accordance with claim 1, including a split tubular retainer mounted on the shank portion of said bit member for retaining said bit member against axial movement relative to said block member while permitting rotation of said bit member relative to said block member.

16. A cutter bit device in accordance with claim 1, wherein the said retainer is on substantially all of the exposed external surfaces of said shank portion, and said retainer being held non-rotational relative to said block member so as to accept substantially all of the wear on the bore of the block member resulting from interaction between the shank portion and the bore.

17. A combination of a cutter bit member adapted for rotational movement relative to a mounting block member, said cutter bit member having a conical head portion and an integral reduced diameter shank portion, said shank portion being disposed for rotational movement within an axial bore provided in said block member, the conical head portion of said cutter bit member having a rearwardly extending skirt-like flange portion, said skirt-like flange portion defining an annular interior, cam-like seat surface adapted to receive therein a forwardly extending annular, exterior cam-like follower surface provided on said block member, said cam-like follower and seat surfaces together providing a thrust-bearing connection during rotation of said cutter bit member relative to said block member, and the annular cam-like surface of said skirt-like flange portion has a generally inverted frusto-conical configuration adapted for thrust-bearing rotational movement on a generally correspondingly frusto-conical surface defined by the cam-like follower surface provided on the said block member.

* * * * *